US005428914A

United States Patent [19]

Whitehouse et al.

[11] Patent Number: 5,428,914

[45] Date of Patent: Jul. 4, 1995

[54] MODULAR SIGNAGE SYSTEM

[76] Inventors: Roger Whitehouse, 201 W. 92nd St., New York, N.Y. 10025; Donall B. Healy, 35A Jane St., New York, N.Y. 10014

[21] Appl. No.: 746,648

[22] Filed: Aug. 15, 1991

[51] Int. Cl.[6] ..... G09F 7/04

[52] U.S. Cl. ..... 40/621; 40/622; 40/657; 40/594; 434/365; 446/137; 446/901

[58] Field of Search ..... 40/622, 621, 657, 594, 40/595, 600, 611, 585, 663, 669; 434/365, 407, 409, 428, 429, 430; 446/118, 137, 901

[56] References Cited

FOREIGN PATENT DOCUMENTS

| | | | |
|---|---|---|---|
| 0243810 | 11/1987 | European Pat. Off. . | |
| 1406138 | 6/1965 | France . | |
| 1542433 | 9/1968 | France . | |
| 2124750 | 9/1972 | France . | |
| 8702159 | 4/1987 | Germany . | |
| 1364469 | 8/1974 | United Kingdom . | |
| 1414141 | 11/1975 | United Kingdom | 40/622 |
| 2007901 | 5/1979 | United Kingdom . | |
| 2236206 | 3/1991 | United Kingdom | 40/622 |

OTHER PUBLICATIONS

Interior 30—536.01—two sided page.
Interior 30—537.01—two sided page.
Modulex Interior 30 (Brochure).
Modulex Interior 30—Free Style (Brochure).

*Primary Examiner*—Brian K. Green
*Attorney, Agent, or Firm*—Darby & Darby

[57] ABSTRACT

A modular sign comprises a perforated base having a multiplicity of apertures spaced a predetermined distance apart in both horizontal and vertical directions and a plurality of sign modules positioned on the base. Each sign module has at least two registration projections on its rear surface for engaging two of the apertures in the base. The projections are located with respect to the edges of the sign module such that the edges of adjacent modules are separated by a predetermined distance to create a reveal between adjacent modules when the registration projections are placed within appropriate ones of said apertures. An adhesive or magnetic tape holds the sign module in place on the perforated base.

19 Claims, 3 Drawing Sheets

MODULAR SIGNAGE SYSTEM

This invention relates to signs. More particularly, this invention relates to a modular sign system, i.e., a sign which is made up of two or more sign modules.

Many signs today comprise a combination of small signs on a common base. For example, an elevator landing in an office building may contain a single sign which contains the egress plan, floor number, and a listing of tenants on that floor. In addition to these messages, the sign may include decorative components such as wood frames or brass headers and/or footers.

Many of these sign elements (for example, the tenant listings) may change from time to time and the need to change these individual sign elements has been recognized for many years. Ideally, such a sign element should be replaced by an element of the same size with minimal time and effort. In some instances, there is a need for vandal resistance, that is, while the sign elements need to be changed, the new element must be secured in such a way that it is difficult to remove the new element.

As used herein, the term "sign module" refers to a sign element or subset of a sign. The module may contain a message or it may include a decorative or structural portion of a sign such as a header or frame. The module may be made of any material. Plastic typically is used for a written message (e.g, tenant listings, etc.) although aluminum, steel, glass, wood, plastic laminates, ceramic tiles and porcelain enameled steel are also commonly used.

Currently known modular sign systems typically are limited in the number and type of materials that can be used. Typical systems are restricted to aluminum extrusions or molded plastic materials. Such systems also tend to have a distinctive look that cannot easily be tailored to unique architectural environments except to the extent that the color or graphics can be changed. Moreover, the known systems are difficult to alter significantly in size and/or shape without going to substantial expense.

The principle object of the present invention is to provide a modular sign system in which sign modules made of virtually any desired material can be readily changed.

A more specific object of the invention is to provide a modular sign system which has no characteristic or distinctive look and which, therefore, can blend with all types of architectural environments.

A further object of the invention is to provide a modular sign system which has the appearance of a costly product yet is inexpensive to manufacture.

In addition to the foregoing, there is an increasing need for a sign system that allows the end user to make and use sign messages themselves. With the advent of laser printers and computer controlled vinyl cutters, retail customers have developed the ability to make highly attractive signs. However, the hardware used currently to hold "in-house" signs comprises plastic frames with a snap-in clear plastic lens or a "window sign" where the message slides in between two layers of plastic, the top being clear except for an opaque border used to conceal the mounting of the lens to the base.

It is a feature of the present invention that a clear lens module can be provided which requires neither an opaque border nor a frame. Moreover, the clear lens systems used in accordance with the invention, unlike existing clear lens system, can be combined with braille and/or tactile sign elements which can be "read" by the blind or visually impaired people.

SUMMARY OF THE INVENTION

In accordance with the invention, a modular sign system comprises a perforated base having a multiplicity of precisely located apertures. Each sign module comprises a plaque and registration projections on the back of the plaque which, when inserted into the apertures in the base, precisely position the module with respect to the base. Additional means, for example magnetic or adhesive, may be provided to maintain the sign module in position on the perforated base.

In accordance with the preferred embodiment, the registration projections are located with respect to the module so that when adjacent modules are positioned on the perforated base there is a small gap or reveal of predetermined size between the adjacent modules. The modules may be made of any material and a wide variety of different modules of standard sizes can be combined to provide many different effects capable of blending into virtually any architectural environment, both indoors and outdoors.

DETAILED DESCRIPTION OF THE INVENTION

Figure 1:
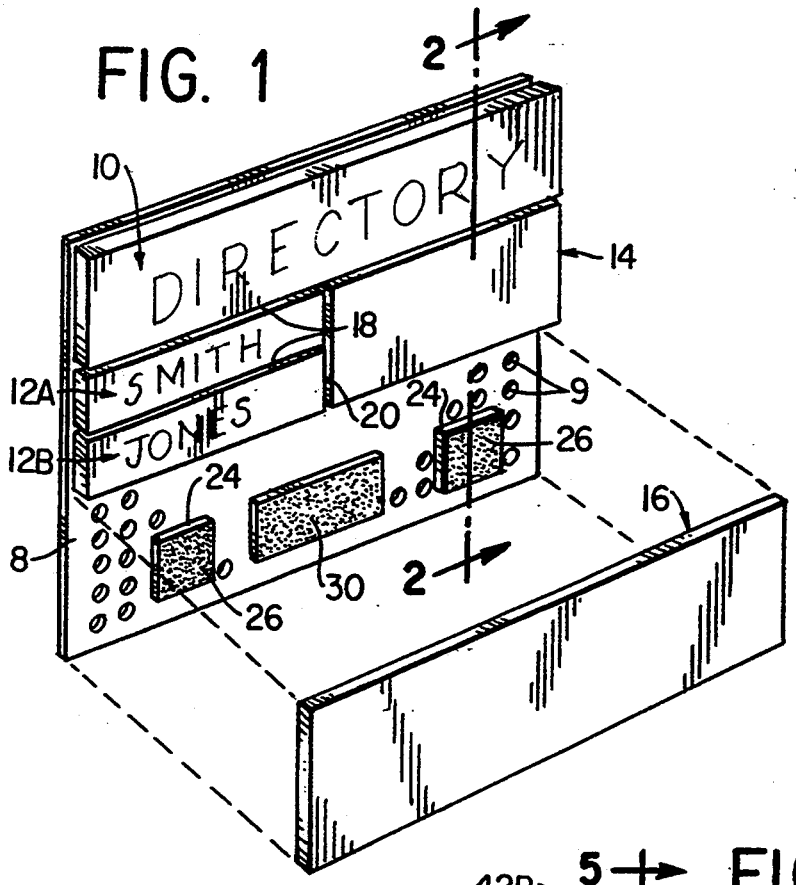
FIG. 1 is a perspective view of a typical modular sign in accordance with the invention, with one of the sign modules shown separated into its components for purposes of explanation.

In FIG. 1, the invention is shown as comprising a perforated base 8 to which sign modules 10, 12A and 12B, and 14 are attached. Base 8 includes a multiplicity of registration apertures 9, preferably over its entire area and accurately spaced in both horizontal and vertical directions so that the various sign modules can be located precisely on the base 8. For purposes of explanation, sign module 16 is shown with its components separated; sign modules 12A and 12B are shown with horizontal and vertical dimensions half the horizontal and vertical dimensions of the module 10; and module 14 is shown as having one half the horizontal dimension of module 10 but the same vertical dimension.

Figure 2:
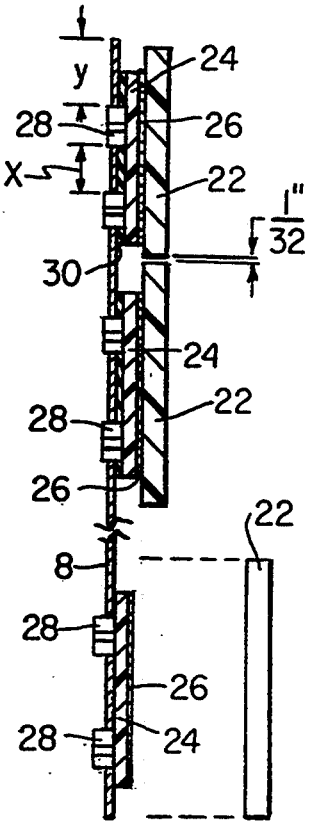
FIG. 2 is sectional view along the line 2—2 of FIG. 1.

The sign modules are separated by horizontal gaps or reveals 18 and, in the case of the modules 12A, 12B and 14 a vertical reveal 20. A reveal is a small space between adjacent sign modules, for example 1/32 inch as shown in FIG. 2 which, as explained below, has both an aesthetic and functional purpose in the invention.

Each of the modules may be structurally identical and, therefore, only one is described. In the illustrated embodiment, a sign module comprises a plaque 22 (for example, containing the sign indicia) and a registration pad 24 secured to the rear surface of plaque 22 by an adhesive layer 26. The rear or exposed surface of the registration pad 24 includes projections 28 adapted to be received in the apertures 9 of perforated base 8.

For the purpose of establishing a reference, as used herein, the "front" of the sign module is the exposed surface of the module containing indicia, i.e., the surface of the sign seen by an observer. The "rear" surface is the opposite surface, i.e., the surface from which the projections 28 extend. The terms "horizontal" and "vertical" likewise are intended only to establish a frame of reference and not any specific orientation of the sign with respect to earth.

In the illustrated embodiment, each of the modules 10, 12, 14 and 16 includes two registration pads 24. Each registration pad includes four projections 28 which, in the preferred embodiment, have a cross section in the form of a cross (see FIG. 3). Preferably, the registration pad is an injection molded plastic with the projections 28 integrally formed therewith. By way of example, registration pads 24 may be molded from ABS; the pad 24 may be 0.030 inches thick with the projections 28 extending 0.030 inches, the diameter of each projection being 0.1875 inches (3/16 inch). Obviously, neither the number of pads 24 nor the number of projections 28 is a critical feature of the invention though a minimum of two (and preferably four) are needed for accurate registration of the sign module on the base.

Figure 3:
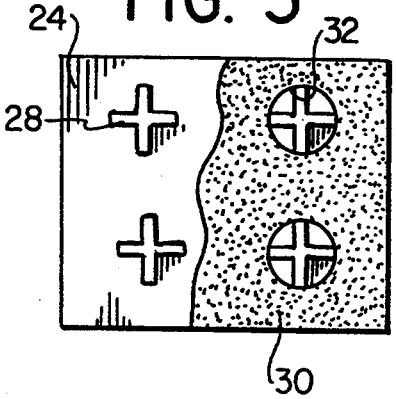
FIG. 3 is a bottom plan view, partially broken away, of a preferred embodiment of a registration pad of locating the modules on the base.

While conceivably, projections 28 may be capable of securing the sign modules to the base 8, the function of the projections 28 is to register the sign modules accurately on the base 8. Accordingly, in the preferred embodiment, attachment means are used to hold the modules on the base. As shown in FIGS. 2 and 3, such means may comprise a tape 30 having apertures 32 conforming to the apertures 9 of base 8. Instead of overlying pads 24 as shown on modules 12 and 14, the tape 30 may be positioned between the pads, with the tape equal in thickness to pad 24 (e.g., 0.030 inches) to maintain a desired gap between the sign module and base. This configuration is shown in connection with module 16. If a permanent connection is desired, tape 30 may contain a very aggressive (tacky) adhesive on both sides. A less tacky adhesive on the rear surface of the tape 30 may be used where replacement of the modules is desirable. Alternatively, tape 30 may comprise conventional magnetic tape adhesively secured to the rear surface of the pad 24. If the base 8 is made of a magnetic material such as steel, magnetic tape 30 will hold the sign modules on the base yet permitting removal of the modules if it is desired to replace them. By way of example, Koroseal magnetic tape available from RJF International Corp. (or 3M) may be used as tape 30. The thickness of such tape may be 0.03 inches, corresponding to the thickness of the registration pad, thereby allowing the tape to be placed between two registration pads without inhibiting the contact of either the tape or the registration projections to the base. The length of the projections 28 should not be so long that they will abut against the surface on which the base 8 is mounted since this might prevent the tape 30 from contacting the base.

An important feature of one aspect of the invention is the fact that the sign modules are slightly "undersized" to create a reveal or gap. Reveals, both horizontal and vertical serve an esthetic purpose by visually separating adjacent modules. Equally, if not more important, in the present invention the slightly undersized modules eliminate the need for precisely cutting the modules or aligning the projections 28 with respect to the plaques 22 which would be necessary if the sign modules were intended to abut against each other. If it were intended that adjacent sign modules were to contact each other, a slight error in cutting or misalignment of the projections on the back of the sign modules would make it difficult, if not impossible, to insert a module. Thus, in accordance with this feature of the invention, an alignment jig as shown in FIGS. 4 and 5 is used to align a slightly "undersized" module with respect to the projections 28.

In a preferred embodiment, a gap or reveal of 1/32 inch is desired. Continuing with this example, if a sign module nominally six inches long and three fourths inch high is desired, the undersized module in accordance with this feature of the invention would be 5 and 31/32 inches long and 23/32 inches high with the projections placed on the back of the module so that the module is centered as precisely as possible, i.e., with 1/64 inches "taken" from each side of the sign module. In this way, when two modules are placed on the base 8 next to each other, the gap between them will be 1/32 inch. This gap or reveal thus provides a tolerance in the event of a slight misalignment of the projections 28 with respect to the plaques 22, or a tolerance in the event of a slight under or over sizing of plaques 22.

Figure 4:
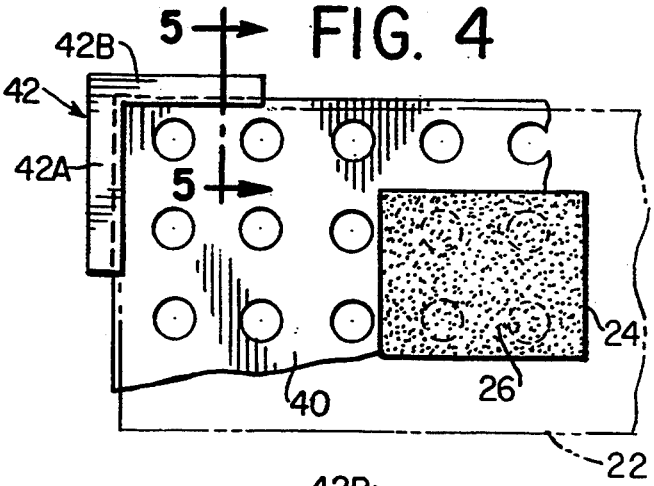
FIG. 4 is a top plan view partially broken away showing a device for aligning the registration pads and sign plaques so that a predetermined reveal will exist between adjacent sign modules.
Figure 5:
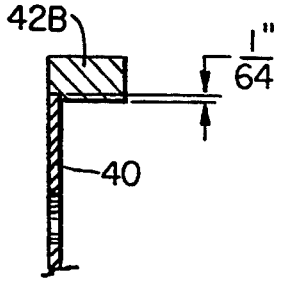
FIG. 5 is a sectional view along the line 5—5 of FIG. 4.

Continuing with the example, and referring now to FIGS. 4 and 5, the alignment jig may comprise a perforated base 40 having a corner alignment bracket 42 attached thereto in one corner. Alignment bracket 42 includes a vertical leg 42A and a horizontal leg 42B.

Alignment base 40 has exactly the same configuration of apertures as the sign base 8 and the alignment bracket 42 is positioned with respect to the base 40 so that each of the legs 42A and 42B overlap the corresponding edges of the base 40 by 1/64". The dimensions of the alignment base 40 are precisely determined so that if a sign module of the nominal dimensions (i.e., 6 inches × $\frac{3}{4}$ inch in this example) were aligned exactly with the corner of the base 40, the alignment of the sign module with respect to the apertures in base 40 would be exact. Thus, the alignment bracket 42, by providing a 1/64 inch offset on the vertical and horizontal dimensions, will result in the actual "undersized" module (i.e., 5 31/32 inches × 23/32 inches) being precisely located with respect to the apertures of the alignment base 40, and, therefore, sign base 8. If the edges of the base 8 are to be flush with the edges of the sign module, base 8 will likewise be undersized by the same amount.

The use of the alignment jig shown in FIGS. 4 and 5 to produce sign modules of the type shown in FIGS. 1 and 2 is simple. The first step is to insert the projections 28 of a registration pad or pads 24 into the desired apertures of alignment base 40. Any of the apertures can be used but typically an effort would be made to position the plaque 22 symmetrically with respect to the pad or pads 24. When the pads 24 are in place in the alignment base 40, adhesive 26 is applied to the exposed surface of the pads 24. Preferably, the protective paper from a double sided self-adhesive layer, such as VHB Tape manufactured by the 3M Company, is removed exposing the top adhesive layer. Then, the rear surface of the sign plaque 22 is brought into engagement with the adhesive with the upper left-hand corner of the sign module pressed against the vertical and horizontal legs 42A and 42B of alignment bracket 42. When the adhesive 26 cures, the sign module can be removed from the alignment base 40. Of course, by placing an alignment bracket 42 in each corner of the base 40, four sign modules can be produced substantially simultaneously. After the module has been removed from the alignment device, the adhesive or magnetic tape 30 can be adhered to the back of the pad 24 or directly to the back of plaque 22 between pads 24.

Figure 6:
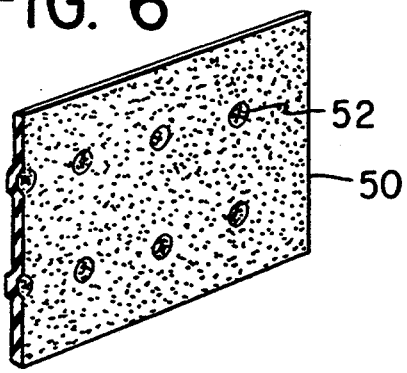
FIG. 6 is a perspective view of a magnetic registration pad in accordance with a second embodiment of the invention.
Figure 7:
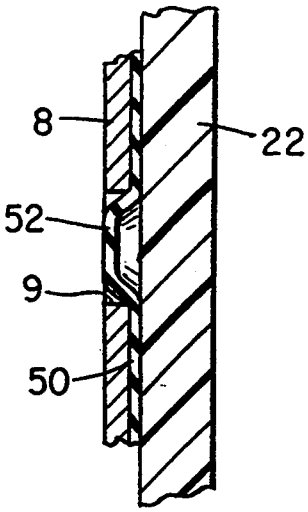
FIG. 7 is a side cross-sectional view showing a sign module attached to a perforated base using the magnetic registration pad of FIG. 6.

FIGS. 6 and 7 illustrate an alternative embodiment of the invention in which the registration pad comprises a magnetic tape 50 having integral projections 52 adapted to be received within the apertures 9 of the sign base 8. The magnetic tape 50 may be attached to the plaque 22 by any suitable adhesive means and may be aligned with respect to the undersized plaque 22 by the alignment jig shown in FIGS. 4 and 5. The embodiment of FIGS. 6 and 7 has the advantage of not requiring a separate tape 30 to retain the sign module on the base 8.

Magnetic tape suitable for use in accordance with the embodiment of FIGS. 6 and 7 is commercially available under the trademark Koroseal from the RJF International Corporation. The tape can be produced in virtually any desired size and the projections 52 molded into the tape. The magnetism may then be applied by conventional means, and the pads cut to size. The use of the magnetic tape eliminates the need for injection molded pin tabs while providing both the necessary registration of the sign plaque on the base and adhesion of the sign module to the base. If a more secure mounting is desirable, additional adhesive means (for example an adhesive vinyl tape) can be used with the magnetic tape shown in FIGS. 6 and 7.

It is also contemplated that a foam or vinyl (neoprene) adhesive tape may be formed with projections comparable to projections 52 to provide both registration and adhesion. The protective paper or film covering the adhesive would have to be of a type that could deform with the vinyl tape when it is molded with projections.

Figure 12:
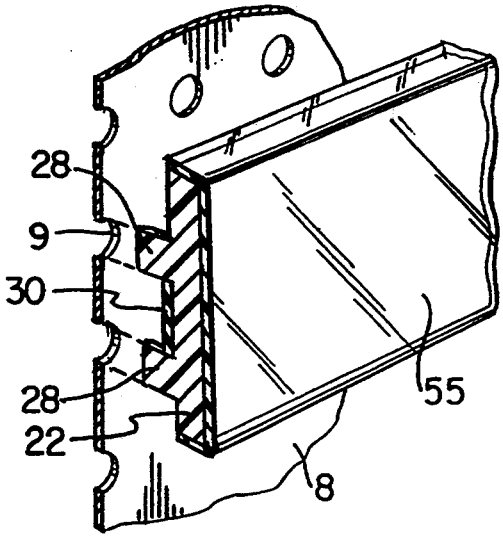
FIG. 12 shows a sign module in accordance with a third embodiment of the invention incorporating a clear lens.

The use of a separate registration pad as shown in FIGS. 1 and 2 and FIGS. 6 and 7 is preferred for several reasons. First, the pads can be adhered to a variety of materials, such as metal, wood, etc., allowing virtually any such material to become a sign module. Second, the registration pads can be applied to sign modules of virtually any size and shape. Injection molds are relatively expensive. By molding a relatively small and simple registration pad, tooling costs can be minimized while accommodating the need for a wide variety of sizes, shapes and materials for sign modules. However, particularly in the case of standard sizes of sign plaques, injection molding of the plaque with the integrally formed projections 28 can be economical. The tooling expense can be reduced if, instead of individual tooling for each size and shape, a large sheet of plastic containing projections 28 is molded and the separate plaques 22 cut from the large sheet. Such a construction is shown in FIG. 12. It is, of course, also important that the projections 28 be located accurately with respect to the undersized plaques, and, for cost purposes, to minimize the number of molds required. For this purpose, a sheet of plastic (for example, six by eighteen inches) may be molded with integrally formed registration projections covering the back of the sheet, and then laser cut into the standard sizes as required. If the kerf of the laser beam is set to 1/32 inches the pieces on each side of the cut would be reduced by the required 1/64 inches on each side.

The sign module 22 shown in FIG. 12 may bear a message printed directly on the exposed face of the module or, as illustrated, it may be covered with a clear plastic lens 55 which forms a snap-fit with the plaque 22 in any conventional fashion. The lens 55 may serve to retain a printed insert (not shown) bearing the desired message and resting against the exposed face of the plaque 22. In the case of the clear lens module shown in FIG. 12, the nominal height of the module (e.g., 23/32 inches) is the top to bottom dimension of the lens 55.

It is further contemplated that a ferrous material in particulate form may be mixed with the plastic prior to molding the plastic registration pads, whether separate (as shown in FIGS. 1 and 2) or molded integrally with the plaque 22 as shown in FIG. 12. If the registration pad and/or plaque contains sufficient ferrous material the pads or sign plaques themselves can be magnetized, possibly eliminating the need for the magnetic or adhesive tape 30. In such a case, the sign module alone would contain both the registration means and the adhesion means to a ferrous metal perforated base. Supplemental adhesion means can be used but, for the more common sizes of plastic sign modules, injection molded plaques which include a ferrous metal powder molded with integral pin tabs would suffice.

Where molded plastic projections are used to provide registration of the sign modules with a perforated metal base 8, the shape of the plastic projections 28 shown in FIGS. 1 and 2 provides important benefits. The use of projections having the cross-sectional shape of a cross (see FIG. 3) accommodates lower tolerances in the perforated base than would a circular pin. Because the cross-shaped pin has less material, if registration of the pin and perforation is not precise, deformation or yielding of the cross-shaped pin is more likely than in the case of a solid cylindrical pin.

Moreover, when the apertures 9 are punched in base 8, by the nature of the process, each aperture is formed with a slight taper. The projections 28 may be molded with a comparable taper. This will make it easier to insert the pin tabs into the apertures and tend to provide a "pressure fit". Conceivably, this may obviate the need to use adhesive or magnetic tape 30 in some situations.

The cross-shaped pins 28 are particularly beneficial when the pins and plaques are injection molded together as a single unit. A solid (e.g., circular) pin will tend to cause a slight depression on the front (exposed) face of the plaque after the molded piece cools. It has been observed that a cross shaped pin does not cause such a depression although the reason why this is so is not known.

One of the important benefits of the invention is its flexibility. In addition to sign modules, headers or frames of virtually any desired material can be secured to the perforated base by the same registration/attachment means. If it is necessary to extend the size of the base, adjacent bases can be automatically aligned and properly spaced by means of the pins 28. For example, if it is desired to extend the base from six to twelve inches, two undersized bases in accordance with the invention (i.e., each 5 31/32 inches long would be automatically spaced by 1/32 inch if bridged by the sign module of FIGS. 1 and 2.

Figure 11:
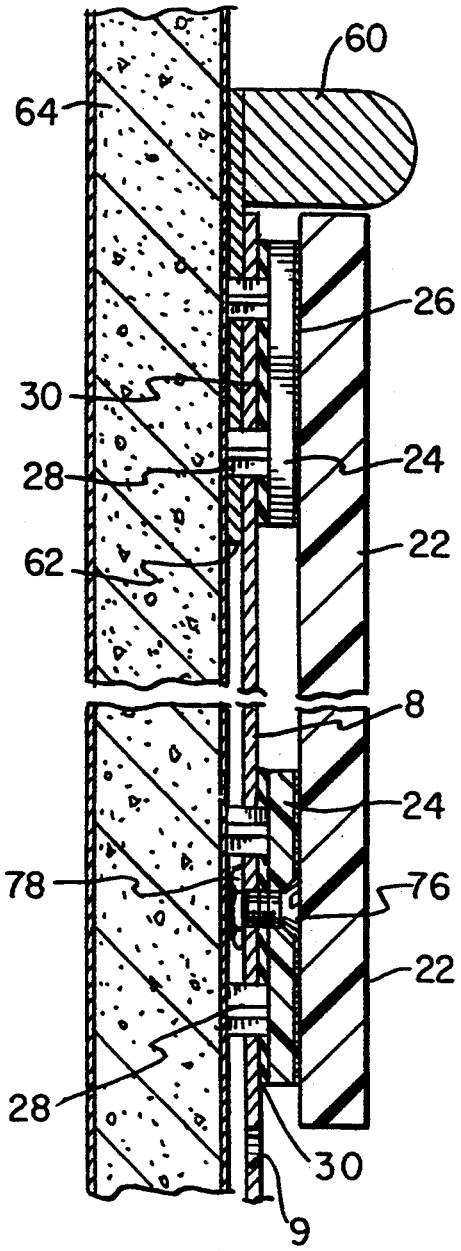
FIG. 11 is a side sectional view showing one way in which a decorative module may be used with the invention and one way of making a vandal resistant connection between a sign module and the perforated base.

The pins 28 shown in FIGS. 1 and 2 can be used to retain overlapping bases 8, for example, if desired to cover an edge by means of a bull nose or other decorative frame or trim. Referring to FIG. 11, a bull nose header 60 may be attached in any suitable way to a perforated sheet 62 identical in configuration to base 8. If the sheet 62 is behind the base 8 in the gap between the base and the wall 64, the pins 28 of a registration pad 24 inserted into base 8 will also engage the holes of the sheet 62 to retain the header in position.

The pattern of the spacing of the holes on the perforated base 8 should be such that standard sign modules will always be aligned in a predetermined fashion. For example, a standard six inch by six inch base 8 may have a grid of sixteen by sixteen holes. This would permit the mounting of nominal six inch long sign modules in nominal height increments of ⅜ inch (although a height of ¾ inch would be preferred to allow at least two projections to register vertically). The perforated base 8 can be flush with the edges of the sign modules or may be set in from the edge of the modules to create a "standoff".

The size of the holes 9 is not critical but must be small enough to permit the holes closest to the edges of the base 8 to be punched without deformation. In the typical perforating process, the holes are preferably set in from the edges approximately 1.5 to 2 times the thickness of the metal being sheared to avoid distortion when sheared on the center line between perforations. In the preferred embodiment, the metal would be sheared 1/64 inch off the center line. Consequently, the distance between holes should be more than 3 times the thickness of the metal base. By way of example, perforated base 8 may be made of 20 gauge steel (0.0359 inches thick), the perforations may be 0.1875 inches (3/16 inch) diameter, and the perforations spaced ⅜ inch on center (dimension x in FIG. 2), with the outer holes set in 0.0781 inches (5/64 inch) from the edges of the base (dimension y in FIG. 2), which falls between the recommended minimum of 1.5 to 2 times the thickness of the material being sheared.

Figure 8:
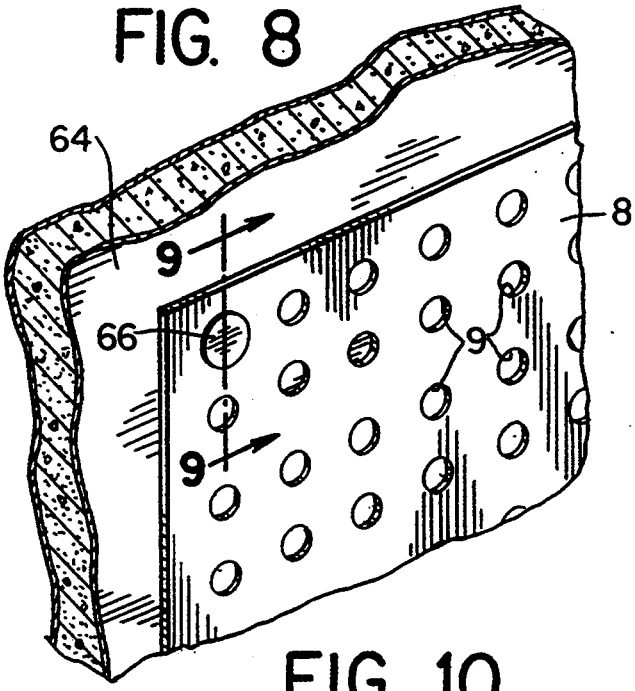
FIG. 8 is a perspective view showing how a perforated sign base may be mounted on a supporting surface.
Figure 9:
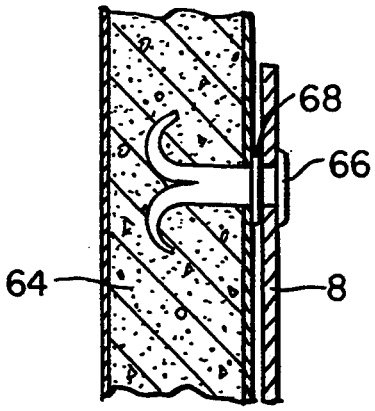
FIG. 9 is a sectional view along the line 9—9 of FIG. 8.

The use of the perforated base also provides great flexibility in terms of mounting arrangements. As shown in FIGS. 8 and 9, base 8 may be attached to a sheetrock or other wall 64 by means of "dome rivet" 66 (only one shown) with a washer 68 spacing the base 8 from wall 64 a predetermined distance, typically 0.030 inches. Two perforated bases can be joined together using a third base (or portion thereof) as a joining strip in which case the washer may not be needed. The use of dome rivets is beneficial since rivets, unlike screws are readily available with heads less than 0.030 inches, the preferred spacing between the rear surface of the plaque 22 and the forward surface of base 8 in which the magnetic or adhesive tape 30 is positioned.

Figure 10:
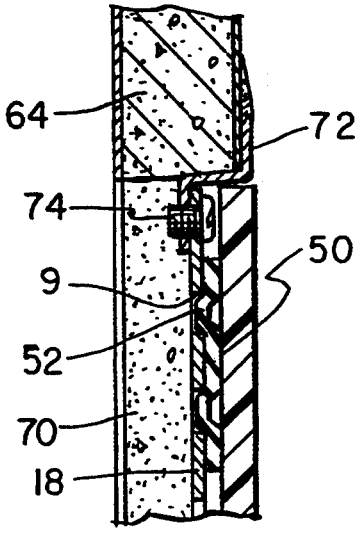
FIG. 10 is a side sectional view showing a preferred means for mounting a modular sign in accordance with the invention within a wall or the like so that the sign is flush with the exterior surface of the wall.

The modular construction using a perforated base lends itself well to flush mounting of a modular sign within an opening 70 in the wall 64 as shown in FIG. 10. In this case a Z-shaped bracket 72 supports the base 8 within the opening 70 with conventional fasteners 74 used to secure base 8 to the interior end of the bracket 72.

Numerous modifications of the invention are possible to provide an extremely wide range of signs for many different purposes. The registration pins or projections can be modified in shape and size, for example to provide a vandal resistant mounting. One possibility might be to have a pin configured as a V that is spring biased apart when the pin is inserted into one of the apertures 9 in the perforated base 8. Similarly, the edges of the pins may be notched to permit the pin to be inserted into an aperture but to make withdrawal difficult. The end of the pin may be threaded to receive a nut. If the sign modules are heavy, supplemental mechanical fastening means may secure the sign module to the perforated base where magnets and/or adhesive means may not suffice. Such mechanical fastening means may include screws, nuts and bolts, etc. As shown in FIG. 11, a countersunk bolt 76 may be placed in the pad 24 before the plaque 22 is attached to the pad. If bolt 70 is pushed through an aperture 9 in base 8, a nut 78 can be fastened to the bolt to provide a firm mechanical connection and vandal resistance.

The use of a perforated base to support the sign modules also provides great flexibility in terms of mounting the sign. A metal base can be bent to orient the mounted sign modules in many different positions with respect to a mounting surface. Likewise, it can be shaped (for example as a "tent") for use as a deskbar. Moreover, accessory devices can be readily provided with suitable mounting projections so that they too can be mounted on a perforated base in accordance with the invention. Such accessories may include a clip for retaining notes, a rotatable multifaceted sign, or an insert retention strip (shaped for example as a J). To the extent such accessories may include registration projections as described herein, they are to be considered "sign modules". While the principal utility of the invention resides in its ability to assemble a number of sign modules to form a complete sign, the invention can be used to form sign assemblies wherein the sign modules do not match and/or where portions of the perforated base are visible. The base itself need not be rectangular and attractive sign assemblies can be made with other bases, for example circular ones.

The perforated base, of course, may be made of any suitable material. A molded, clear plastic base would have utility with illuminated signs such as menu boards.

What is claimed is:

1. A modular sign, comprising:

a perforated base having a multiplicity of registration apertures spaced a predetermined distance apart in both horizontal and vertical directions;

at least two sign modules each having a rear surface and at least two registration projections on said rear surface for engaging at least two of said registration apertures; and holding means on each module supplemental to said registration projections for maintaining said module on said perforated base, one of said holding means and base comprising a magnetic material, and the other comprising a magnet.

2. A modular sign, comprising:

a perforated base having a multiplicity of registration apertures spaced a predetermined distance apart in both horizontal and vertical directions;

at least two signs modules each having a rear surface and at least two registration projections on said rear surface for engaging at least two of said registration apertures, said projections comprising molded plastic pins cross-shaped in cross-section; and holding means on each module supplemental to said registration projections for maintaining said module on said perforated base.

3. A modular sign according to claim 2, wherein said pins are integrally molded with said sign module.

4. A modular sign, comprising:

a perforated base having a multiplicity of registration apertures spaced a predetermined distance apart in both horizontal and vertical directions;

at least two sign modules each having a rear surface and at least two registration projections on said rear surface for engaging at least two of said registration apertures, wherein said projections comprise molded plastic pins cross-shaped in cross-section, each of said sign modules comprising a plaque and at least one registration pad attached to one side of said plaque, said registration projections extending from the registration pad; and holding means on each module supplemental to said registration projections for maintaining said module on said perforated base.

5. A modular sign, comprising:

a perforated base having a multiplicity of registration apertures spaced a predetermined distance apart in both horizontal and vertical directions;

at least two sign modules each having a rear surface and at least two registration projections on said rear surface for engaging at least two of said registration apertures, holding means on each module supplemental to said registration projections for maintaining said module on said perforated base, each said sign module being made of a molded plastic material and said holding means comprising a magnetic material interspersed in said sign module, and wherein said perforated base includes a magnetic material.

6. A modular sign, comprising:

a perforated base made of a magnetic material and having a multiplicity of registration apertures spaced a predetermined distance apart in both horizontal and vertical directions;

at least two sign modules each having a rear surface and at least two registration projections on said rear surface for engaging at least two of said registration apertures, each said sign module comprising a plaque and a magnetic tape attached to a surface of said plaque, said magnetic tape containing said registration projections and serving as a holding means to maintain said module on said perforated base.

7. A modular sign, comprising:

a perforated base having a multiplicity of registration apertures spaced a predetermined distance apart in both horizontal and vertical directions;

at least two sign modules each having a rear surface and at least two registration projections on said rear surface for engaging at least two of said registration apertures; and holding means on each module supplemental to said registration projections for maintaining said module on said perforated base, said holding means comprising a magnetic tape attached to the rear surface of said sign module and including apertures through which said projections extend, and wherein said perforated base includes a magnetic material.

8. A modular sign, comprising:

a perforated base having a multiplicity of apertures spaced a predetermined distance apart in both horizontal and vertical directions;

at least two sign modules each having a rear surface, side edges, and at least one registration pad attached to said rear surface, said registration pad including at least two projections for engaging at least two of said apertures, said pad being located with respect to the edges of the associated sign module such that the edges of adjacent modules are separated by a predetermined distance to create thereby a reveal between adjacent modules when said projections are placed within appropriate ones of said apertures; and holding means on each module for holding said modules on said perforated base independently of said registration projections, said holding means comprising a magnetic material between each said module and said base, and wherein said base includes a magnetic material.

9. A modular sign, comprising:

a perforated base having a multiplicity of apertures spaced a predetermined distance apart in both horizontal and vertical directions;

at least two sign modules each having a rear surface, side edges, and at least one registration pad attached to said rear surface, said registration pad including at least two projections for engaging at least two of said apertures, said pad being located with respect to the edges of the associated sign module such that the edges of adjacent modules are separated by a predetermined distance to create thereby a reveal between adjacent modules when said registration pad projections are placed within appropriate ones of said apertures, said projections comprising molded plastic pins cross-shaped in cross-section.

10. A modular sign, comprising:

a perforated base having a multiplicity of apertures spaced a predetermined distance apart in both horizontal and vertical directions;

at least two sign modules each module comprising a plaque having a rear surface, side edges, and at least two registration pads attached to said rear surface, said registration pads including at least two projections extending therefrom for engaging at least two of said apertures, each said pad being located with respect to the edges of the associated sign module such that the edges of adjacent modules are separated by a predetermined distance to create thereby a reveal between adjacent modules when said projections are placed within appropriate ones of said apertures, wherein said projections comprise molded plastic pins cross-shaped in cross-section.

11. A modular sign, comprising:

a perforated base having a multiplicity of apertures spaced a predetermined distance apart in both horizontal and vertical directions;

at least two sign modules each having a rear surface, side edges, and at least one registration pad attached to said rear surface, said registration pad including at least two registration projections for engaging at least two of said apertures, said pad being located with respect to the edges of the associated sign module such that the edges of adjacent modules are separated by a predetermined distance to create thereby a reveal between adjacent modules when said registration projections are placed within appropriate ones of said apertures; and holding means on each module for holding said modules on said perforated base independently of said registration projections, wherein each said sign module is made of a molded plastic material and said holding means comprises a magnetic material interspersed in said sign module, and wherein said perforated base includes a magnetic material.

12. A modular sign, comprising:

a perforated base having a multiplicity of apertures spaced a predetermined distance apart in both horizontal and vertical directions;

at least two sign modules each having a rear surface, side edges, and at least one registration pad attached to said rear surface, said registration pad including at least two registration projections for engaging at least two of said apertures, said pad being located with respect to the edges of the associated sign module such that the edges of adjacent modules are separated by a predetermined distance to create thereby a reveal between adjacent modules when said registration projections are placed within appropriate ones of said apertures, wherein each said sign module comprises a plaque and a magnetic tape attached to a surface of said plaque, said magnetic tape containing said registration projections, and wherein said perforated base is made of a magnetic material.

13. A modular sign, comprising:

a perforated base having a multiplicity of apertures spaced a predetermined distance apart in both horizontal and vertical directions;

at least two sign modules each having a rear surface, side edges, and at least one registration pad attached to said rear surface, said registration pad including at least two registration projections for engaging at least two of said apertures, said pad being located with respect to the edges of the associated sign module such that the edges of adjacent modules are separated by a predetermined distance to create thereby a reveal between adjacent modules when said registration projections are placed within appropriate ones of said apertures;

holding means on each module for holding said modules on said perforated base independently of said registration projections, said holding means comprising a magnetic tape attached to the rear surface of said sign module and including apertures through which said projections extend, and wherein said perforated base includes a magnetic material.

14. A sign module for attachment to a perforated base having a multiplicity of apertures spaced a predetermined distance apart in both horizontal and vertical directions, said sign module having a rear surface, side edges, and at least two registration projections on said rear surface for engaging at least two of said apertures, said projections being located with respect to the edges of the sign module such that when the sign module is placed on the perforated base adjacent a similarly constructed sign module, the adjacent edges of the modules will be separated by a predetermined distance to create thereby a reveal between them, and holding means associated with said sign module for maintaining said sign module on said base, said holding means comprising a magnet.

15. A sign module according to claim 14, wherein said magnetic material comprises ferrous particles dispersed in said sign module.

16. A sign module for attachment to a perforated base having a multiplicity of apertures spaced a predetermined distance apart in both horizontal and vertical directions, said sign module having a rear surface, side edges, and at least two registration projections on its rear surface for engaging at least two of said apertures, said projections being located with respect to the edges of the sign module such that when the sign module is placed on the perforated base adjacent a similarly constructed sign module, the adjacent edges of the modules will be separated by a predetermined distance to create thereby a reveal between them, and holding means associated with said sign module for maintaining said sign module on said base, wherein said registration projections are cross shaped in cross section.

17. A modular sign, comprising:

base means for supporting at least two sign module means;

at least two sign module means for presenting preselecting indicia to a view, at least one of said base means and sign module means having a multiplicity of registration apertures spaced a predetermined distance apart in both horizontal and vertical directions, the other of said base means and sign module means having at least two registration projections for engaging at least two of said registration apertures; and holding means supplemental to said registration projections and said registration apertures for maintaining said sign module means on said base means, said holding means comprising a magnet associated with one of said means and a magnetic material associated with the other of said means.

18. A modular sign, comprising:

base means for supporting at least two sign modules;

at least two sign modules each having a rear surface, side edges, and registration pad means attached to said rear surface for registering said sign module on said base means, at least one of said base means and sign modules having registration apertures spaced a predetermined distance apart in both horizontal and vertical directions, the other of said base means and sign modules having at least two registration projections for engaging at least two of said apertures, each said registration pad means being located with respect to the edges of the associated sign module such that the edges of adjacent modules are separated by a predetermined distance to create thereby a reveal between adjacent modules when said registration projections are placed within appropriate ones of said apertures; and holding means for maintaining said modules on said base means, said holding means comprising a magnet associated with one of said means and a magnetic material associated with the other of said means.

19. A modular sign, comprising:

a perforated base having a multiplicity of registration apertures spaced a predetermined distance apart in both horizontal and vertical directions;

at least two sign modules each having a rear surface and at least two registration projections on said rear surface for engaging at least two of said registration apertures;

holding means on each module supplemental to said registration projections for maintaining said module on said perforated base; and a further module having a perforated sheet containing apertures corresponding in size and spacing to the apertures in said base, said perforated sheet being positioned behind said base and held in place by the registration projections of at least one of said sign modules, said further module including a sign component extending beyond said perforated base.

* * * * *